US005271350A

United States Patent [19]

Newburger

[11] Patent Number: 5,271,350

[45] Date of Patent: Dec. 21, 1993

[54] OIL TANKER APPARATUS

[76] Inventor: Babette B. Newburger, 76 Birchwood La., Lincoln, Mass. 01773

[21] Appl. No.: 890,661

[22] Filed: May 28, 1992

[51] Int. Cl.[5] ..... B63B 25/08

[52] U.S. Cl. ..... 114/74 A

[58] Field of Search ..... 114/74 R, 74 T, 74 A, 114/69, 6.9, 69, 72, 75, 121, 125, 256, 257, 333; 220/900, 901, 9.1, 562, 564, 4.12, 4.14, 403, 460, 461, 530; 405/210

[56] References Cited

U.S. PATENT DOCUMENTS

| | | | |
|---|---|---|---|
| 3,067,712 | 12/1992 | Doerpinghaus | 114/74 T |
| 3,859,944 | 1/1975 | Warner . | |
| 3,922,985 | 12/1975 | Hamilton . | |
| 4,230,061 | 10/1980 | Roberts . | |
| 4,347,798 | 9/1982 | Gallagher . | |
| 4,982,678 | 1/1991 | Frederick | 114/74 R |
| 5,038,960 | 8/1991 | Seery | 220/403 |
| 5,119,749 | 6/1992 | Velleca | 114/74 T |

FOREIGN PATENT DOCUMENTS

| | | | |
|---|---|---|---|
| 1044549A | 9/1983 | U.S.S.R. | 114/74 T |

*Primary Examiner*—Robert J. Oberleitner
*Attorney, Agent, or Firm*—Herbert L. Gatewood

[57] ABSTRACT

Apparatus for protecting against spillage of oil and similar cargoes carried in a tanker vessel upon high-energy impact of the hull 10 of the vessel with another object. The apparatus comprises a series of bladder modules whose walls are made of flexible material of sufficient strength to substantially withstand rupture upon such impact. Each flexible module comprises an inboard cargo-carrying bladder 16 surrounded outboardly by a buffer bladder 12 containing air under pressure. Such buffer bladder 12 may alternatively contain water or other ballast liquid when desired to maintain seaworthiness of the vessel.

10 Claims, 5 Drawing Sheets

OIL TANKER APPARATUS

FIELD OF THE INVENTION

This invention relates primarily to ocean-going cargo vessels specially adapted to carry oil, gasoline and similar bulk fluids.

BACKGROUND OF THE INVENTION

The modern world depends heavily on sea-going oil tankers for the delivery of oil and oil products in bulk from the area of; extraction to areas of refining or use. While sea-going vessels remain a relatively inexpensive method of transporting large quantities of such products, they are subject to special risks, particularly the risk of collision with another vessel or an obstruction which may result in spillage of oil products into open waters. While statistically such rupture to the vessel resulting in spillages are rare, the catastrophic effects of any such spillages have made this risk a very major world environmental problem. As a famous example, the EXXON VALDEZ accident in Prince William Sound, Alaska, in 1989 caused damage to the environment not fully repaired, even though billions of dollars have been spent in clean-up efforts.

Traditionally, a sea-going oil tanker has a single skin, fabricated from steel, protecting the cargo from the surrounding sea. After the EXXON VALDEZ and other similar accidents, there has been increased interest in designing oil-carrying ships less likely to cause environmental injury resulting from skin rupture, whether from collision with another object or because of excessive stresses put upon the vessel's structure by the sea. Suggestions have included a variety of designs and techniques, including double hulls, hydrostatic balancing of cargo and the like (for background, see *Tanker Spills—Prevention by Design,* National Research Council (US) Committee on Tank Vessel Design, 1991, National Academy Press, Washington, D.C.). But in particular, any cargo protection system relying only on a rigid, rupturable membrane such as steel is inherently at risk of failure in high-energy impacts resulting from grounding or from collision with rocks or other vessels, or may fail from metal fatigue or other age-related weaknesses.

It has been suggested that a flexible membrane be used to protect oil and similar cargoes from spillage in case of an accident. For example, U.S. Pat. No. 4,347,798 to Gallagher (1982) teaches the use of a closed buffer tank, of flexible material such as a nylon-based elastomer, positioned outboard of the cargo spaces and carrying salt water or other ballast liquids. Gallagher employs a single flexible bladder for each cargo-carrying compartment, segregated from and positioned outboard of the cargo space. The outer wall of that bladder is permanently sealed to the inner wall of the hull.

The protection provided by Gallagher is limited, since any impact rupturing the hull may well also rupture the flexible membrane sealed to it, thus leaving only a single membrane protecting the cargo.

My invention employs simple, readily-installable and removable modules each comprising a combination of a flexible cargo tank and segregated flexible tank made of a tough but resilient material. The bladder configuration is not sealed to the hull. Each bladder system provides within its design the equivalent of a double-side, double-bottom hull, formed by an outer ballast/buffer tank space which is adapted to be pressurized and also to carry a ballast liquid if desired. In case of an impact which ruptures the vessel's steel hull, the resilient walls of the bladder are adapted to deflect and yield in order better to absorb a high-energy impact and deter or eliminate destructive further rupturing, all as described below.

The bladder membrane system is fabricated of a composite of materials that have been researched in depth. Some of these membrane composites are a fraction of the weight of steel and of significantly greater impact resistance.

OBJECTS OF THE INVENTION

Accordingly, this invention is intended to provide at least the following:

(A) a sea-going vessel capable of maintaining a fluid cargo free from significant spillage even upon rupture of the outer hull or bottom of the vessel;

(B) a vessel having one or more flexible cargo-holding bladders capable of withstanding rupture even upon high-energy impact with another object;

(C) a vessel having a multiplicity of independent cargo spaces each contained within a flexible bladder;

(D) a system of such bladders which may be retrofitted into existing single-hulled oil tankers;

(E) A system of bladders that provides the equivalent of side and bottom double hulls while allowing more cargo space with less weight.

(F) Ballast tanks which can also be be drained and filled with pressurized gas for buoyancy and outboard protection.

(G) A modular system which may be installed as a unit and readily removed for inspection and cleaning.

Further objects and advantages will be apparent from the drawings and description contained in this specification.

DEFINITIONS

The following terms shall have the indicated definitions unless the context otherwise requires.

"Tanker" and similar terms shall include all vessels capable of carrying oil, oil products and other bulk goods, whether including an integrated power and steering system, or propelled by another vessel.

"Sea-going" is used for convenience and is not intended to be limited to vessels traveling on the high seas, but includes travel on inland seas, lakes and any other navigable waterway.

"Hull" shall mean the entire watertight skin of a vessel which may contact the surrounding waters traversed by the vessel and shall also refer to interior membranes surrounding the entire cargo, personnel, storage, and other spaces of the vessel.

DESCRIPTION OF A PREFERRED EMBODIMENT

Figure 1:
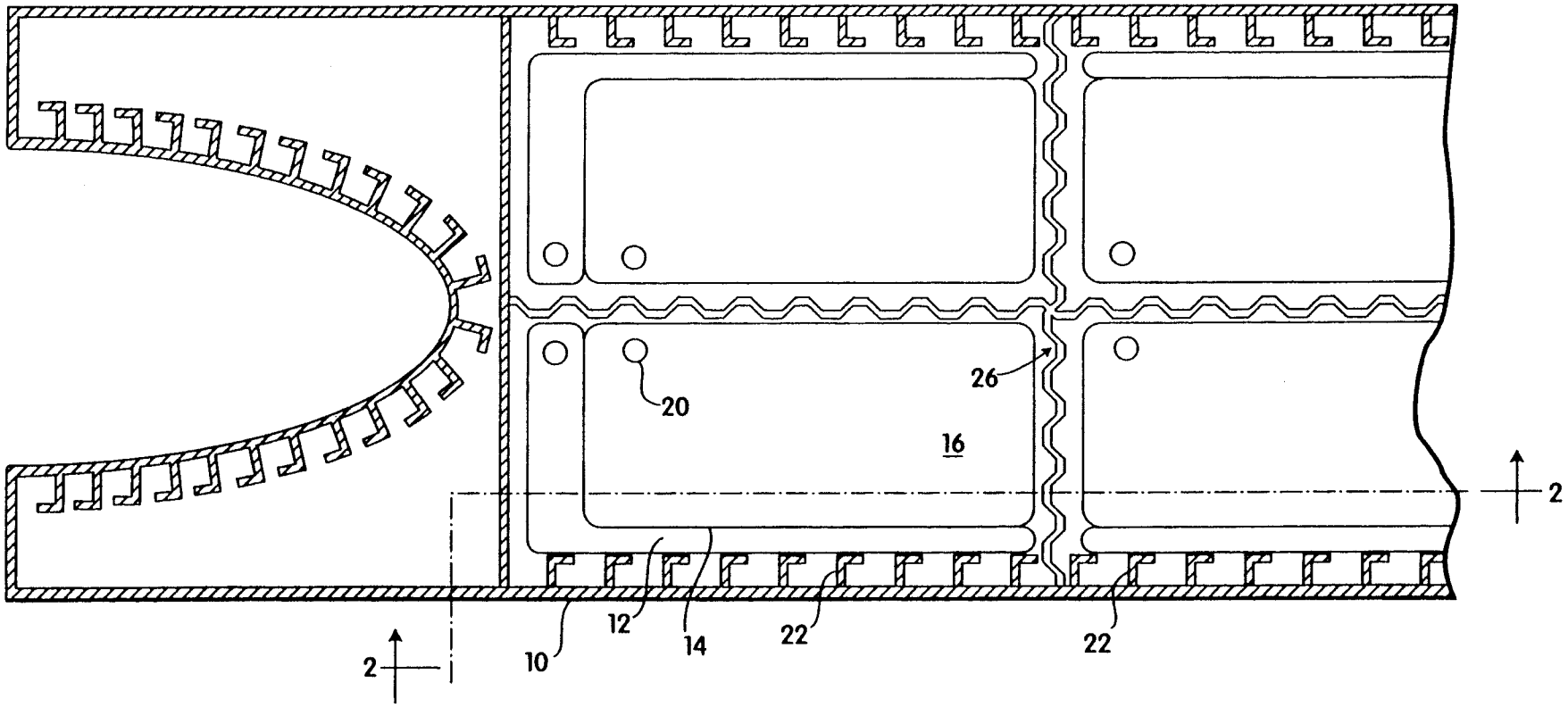
FIG. 1 is a schematic plan cross-sectional view of a portion of a typical oil-carrying tanker of a barge-type incorporating one configuration of flexible ballast and cargo tanks in accordance with my invention, made up of a series of independent buffer bladder and cargo bladder systems.

As shown in FIG. 1, the tanker comprises a rigid outer hull 10 generally made up of steel plates welded and conventionally secured to steel ribs or framing members 22 to provide a water-tight structure capable of creating the necessary buoyancy. Inboard of hull 10 are a series of modular flexible systems each made up of a buffer tank bladder 12 and a cargo tank bladder 16. The inner walls 14 of buffer bladder 12 serve as the outer walls of cargo bladder 16 and are made of a flexible material more particularly described below. Each buffer bladder 12 is configured to provide an outboard protective buffer around modular cargo tank bladder 16. Both buffer bladder 12 and cargo bladder 16 may preferably be adapted to support a conventional submersible pumping assembly 20 capable of exhausting liquid contained within such bladders to conventional piping and manifolds which communicate with external tanks or other receiving means aways from the vessel.

Figure 2:
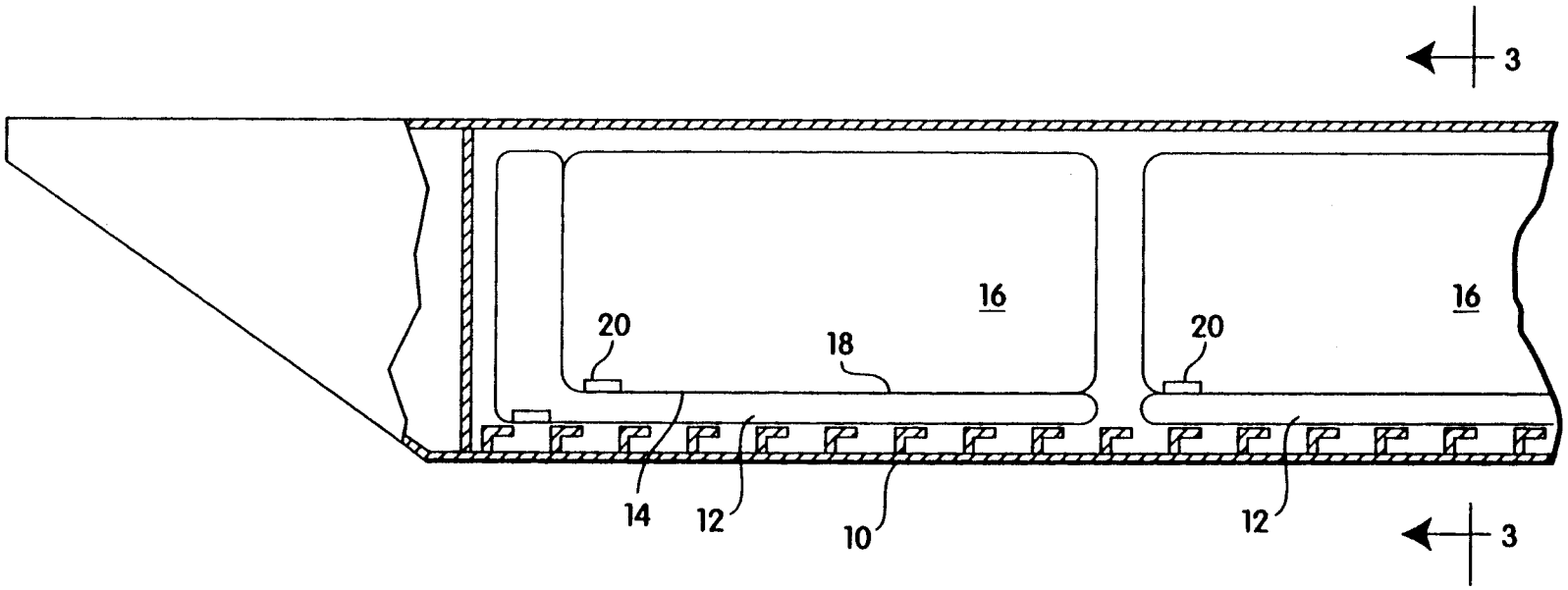
FIG. 2 is a side view of part of a longitudinal section of such a tanker at point 2—2 of FIG. 1.
Figure 5B:
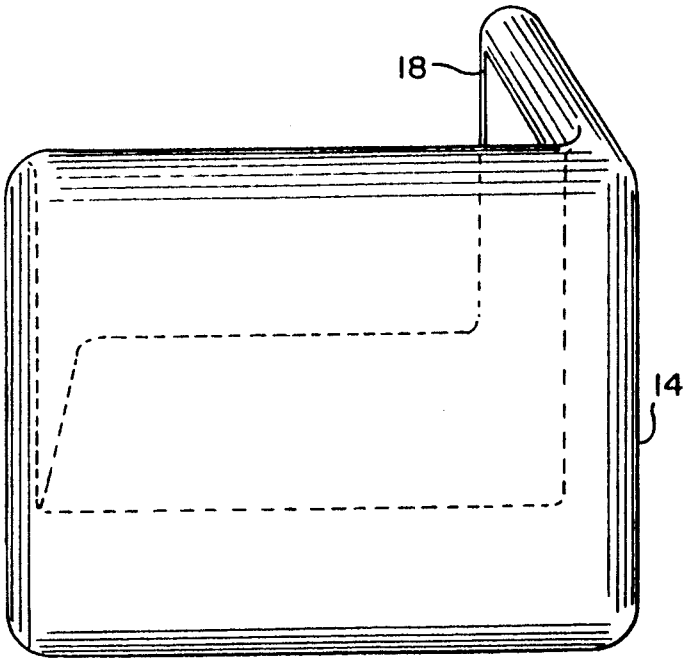
FIG. 5 (A and B) are further perspective views, showing both side and bottom portions of, respectively, intermediate and end buffer/ballast components.
Figure 5A:
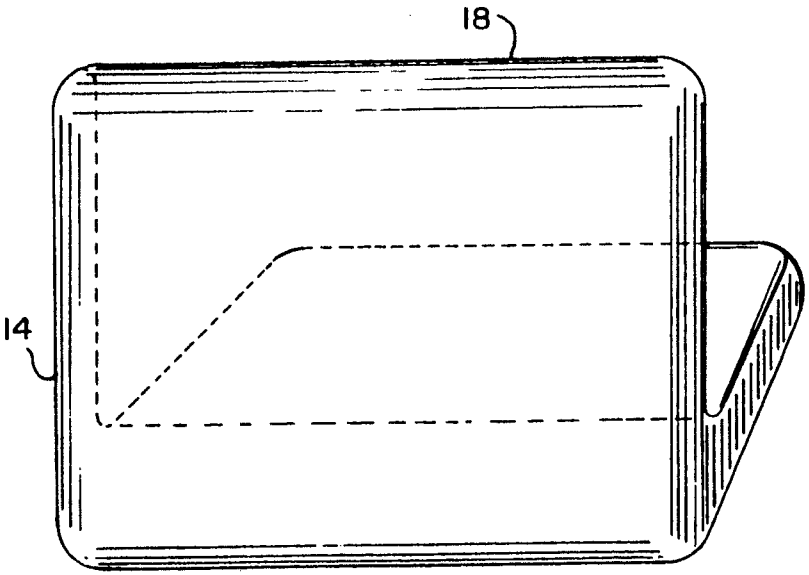

Each buffer tank bladder 12 is L-shaped in transverse cross-section (FIG. 5A), except for the foremost and aftermost pairs of modules, in which buffer tanks 12 extend continuously forward and rearward. respectively and wrap around their adjacent cargo bladders 16 (FIGS. 1, 2, 3) to provide protection against impact from forward and aft respectively.

Figure 3:
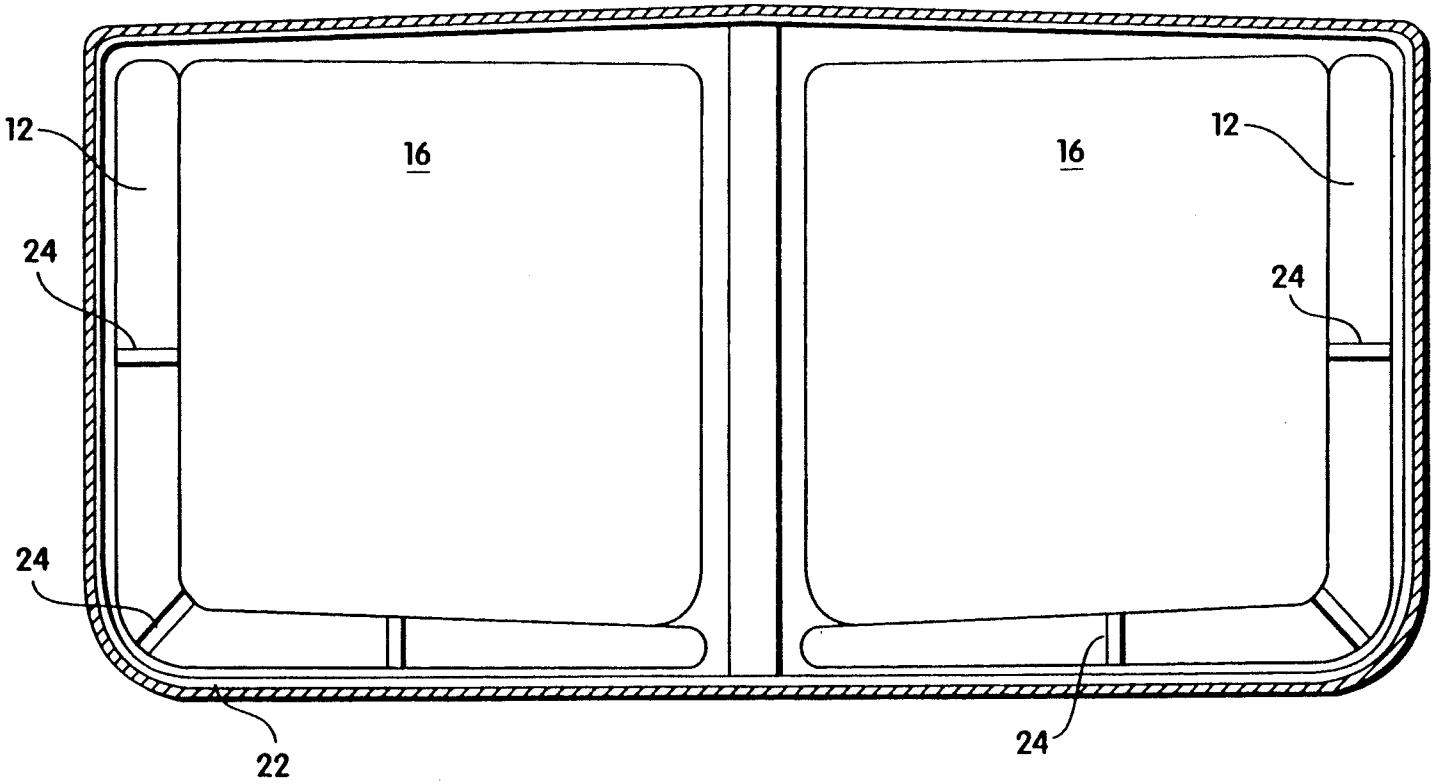
FIG. 3 is a side view of a transverse section of such a tanker at point 3—3 of FIG. 2.
Figure 4:
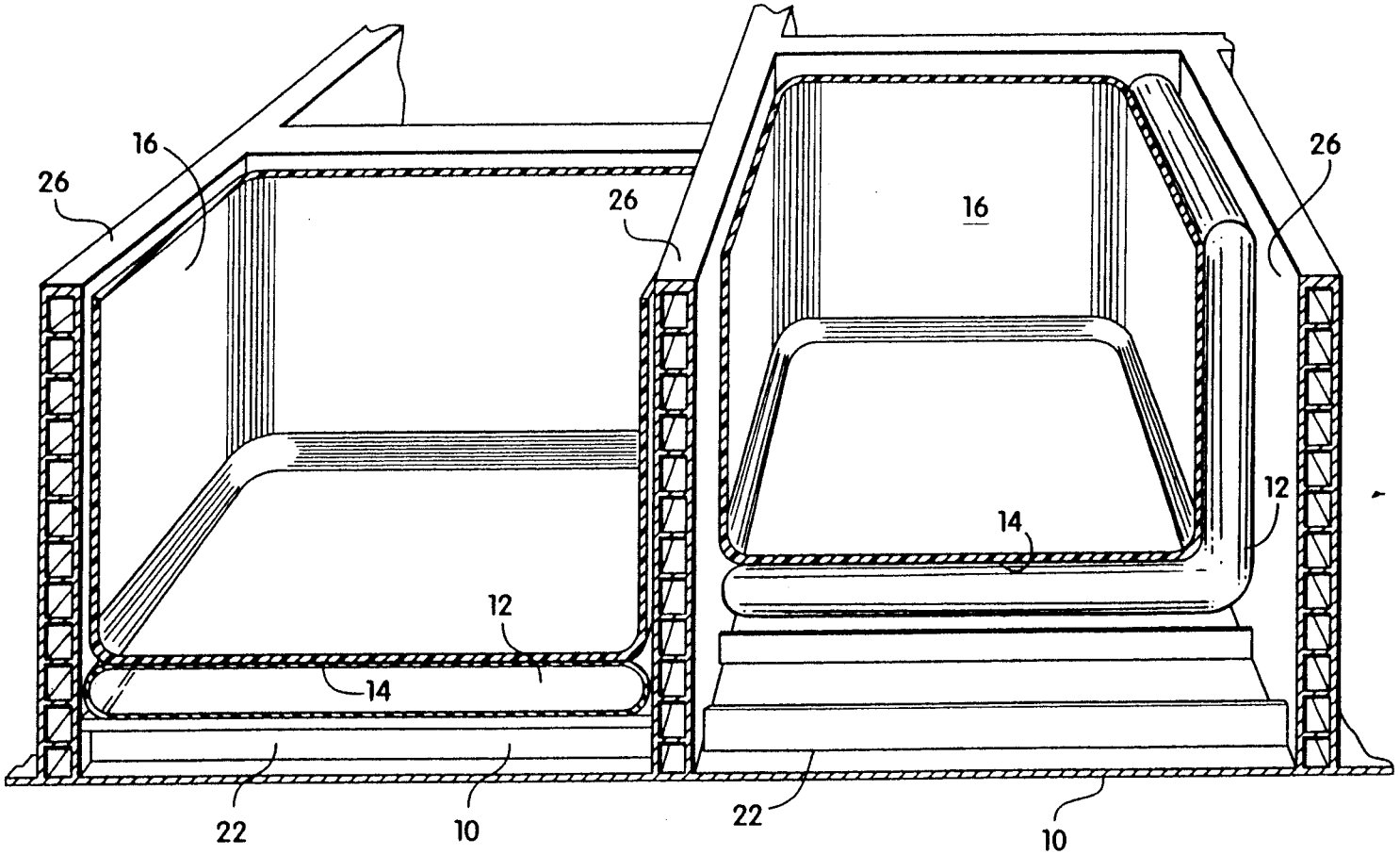
FIG. 4 is a perspective view of a typical ballast-and cargo bladder system embodying the invention herein disclosed.

As shown in FIG. 3, securing ties 24 may be located at intervals as appropriate to maintain the general shape of each buffer bladder 12.

Buffer bladders 12 and cargo bladders 16 may preferably be constructed of a relatively flexible elastomeric material substantially impervious to salt water, oil or other similar products which may be transported. For example, a multiply composite sold by E.I. Du Pont de Nemours, Inc. made up of a Kevlar (R) aramid yarn fabric sandwiched between plies of Neoprene synthetic rubber may be used, as may other elastomers with the desired combination of stiffness and flexibility. Such Neoprene coating should be of sufficient thickness to provide desired stiffness of the walls. Preferably, the wall surfaces of buffer bladders 12 and cargo bladders 16, other than those walls which are in contact with the ballast or cargo liquids, may be coated with a suitable non-invasive lubricating means to reduce abrasion caused by chafing from other ship structures. Such lubricant may preferably also be applied to the inner walls of vessel hull 10, hull ribs 22 and to surfaces of any other internal structure which may come into repeated contact with bladders 12 and 16.

It will be noted that the invention as shown in FIG. 1 provides for air spaces between flexible bladders 12 and 16 and rigid portions of the vessel such as hull 10 and interior bulkheads 26. These may be filled with any suitable inert gas to reduce the likelihood that explosive oil vapors may collect in such spaces.

The invention herein described is particularly suitable for use in barges and other vessels constructed without a continuous closed deck above the cargo area. Bladders 12 and 16, when empty, may be readily lifted from the positions shown, using conventional crane equipment, to permit inspection and repair at dockside, as well as replacement if necessary.

A further advantage of a deck-free space above the cargo area is that, particularly in case of high-energy impact with the sea bottom, the flexible modules may be relatively free to move upward a limited distance to absorb the shock of such an impact without rupturing.

It will be noted that while FIG. 3 shows cargo bladder 16 as integral with buffer bladder 14, this is not critical. In another embodiment, cargo bladder 16 may comprise a complete enclosure which is not attached to buffer bladder 12 but simply rests upon it; similarly, surfaces of cargo tank walls 18 may provide only a snug fit with adjacent surfaces of interior bulkheads 26. If desired, bladders 16 may be configured with vertical ribs to interlock with interior bulkheads 26 having a suitably corrugated configuration, to reduce undesired shifting of bladders 16.

It will also be noted that in one preferred embodiment, not shown, each bladder module may be provided at its top with a suitable securing means which fits releasably over a support means secured to the inner wall of hull 10. Any releasable securing means may however be used, so long as such means do not interfere with the ability of the module to disengage in case of a sudden upward force on bladder 12.

It can be seen that the configuration shown herein provides a multiplicity of safety features not typically provided by a conventional all-steel double hull system. In case of impact with an external body great enough to rupture the steel outer hull, the outer and inner walls of the ballast bladder each provide individual flexible barriers which will tend to yield rather than tear.

Buffer bladder 12 performs a dual function. When its counterpart cargo bladder 16 is loaded with cargo, buffer bladder 12 may be filled with compressed air or other gas to a pressure great enough to keep inner buffer bladder wall 14 spatially well-separated from the outer wall of buffer bladder 12, thus providing additional protection against rupture. When, however, the vessel is empty of cargo or carrying a smaller cargo load, so that ballast is needed to maintain the vessel's maneuverability and seaworthiness, bladder 12 may be filled with salt water or other ballast liquid to the desired level. Also, it may be desirable to fill some bladders 12 with ballast while at the same time filling other bladders 12 with compressed gas.

When bladder 12 is used for ballast as above, it may be filled with salt water to a height above the usual water line of the fully-loaded vessel, giving a water pressure within the ballast bladder that is greater than that of the open sea at that depth. If the ballast bladder is ruptured, its contents will tend to spill out, creating a lifting effect that may, in case of a grounding accident, for example, help free the vessel. If the ballast bladder is not ruptured, the lifting effect may be caused by pumping water from the ballast tanks.

Other advantages over conventional double hulls will be obvious. Inspection and cleaning are facilitated, weight may be reduced and available cargo space increased. The bladders may be assembled at the shipyard to fit a variety of cargo areas and may be readily replaced without substantially dismantling the vessel.

If steel longitudinal and horizontal bulkheads are not required for structural stability in smaller vessels traveling in calmer seas, one selfcontained bladder with multiple cargo compartments may be fitted into the whole cargo space in a single installation, with one large cradling buffer tank surrounding the side and bottom cargo compartment system. The ballast buffer tank space may be walled at intervals into sections, to control the distribution and drainage of water.

Since certain changes may be made in the above configurations and apparatus without departing from the scope of the invention herein described, it is intended that all matter contained in the above description or shown in the accompanying drawings shall be interpreted as illustrative and not in a limiting sense.

I claim:

1. In a bulk liquid cargo carrying vessel having an outer hull enclosing a plurality of liquid cargo carrying spaces defined by intersecting bulkheads; each of which is defined by exterior surfaces, the improvement comprising one or ore modular systems contained in said vessel, each said system capable of being contained within each one of said plurality of cargo carrying spaces and comprising:

(a) a first bladder means capable of being inflated and defining an internal space capable of containing an inert gas or liquid ballast and being positioned inboard of and spatially separated from said hull;

(b) a second bladder means defining an internal space capable of containing bulk liquid cargo being positioned inboard of said first bladder means, and being defined by outer exposed surfaces adjacent the exterior surfaces of the bulkheads, and (c) vertically disposed ribs being provided on the outer exposed surfaces of the second bladder means and vertically disposed ribs of a complementary shape being provided on the exterior surfaces of adjacent bulkheads whereby such ribs can be interlocked with those on the bladder means so as to reduce undesired shifting of said cargo bladder means.

2. Modular system capable of being used in a fluid cargo carrying vessel for the preventing of leakage of the fluid cargo in the event of rupture to the hull of said vessel, said system comprising in combination:

(a) a flexible inner cargo bladder defined by vertically disposed spaced-apart inner and outer walls and an end wall for holding the fluid cargo; and (b) a flexible outer bladder defined by spaced-apart inner and outer, spaced-apart walls, the outer bladder having an L-shaped horizontal cross-section and providing a buffer for and support to, the inner cargo bladder at its outer wall and at the end wall.

3. Modular system according to claim 2 wherein the inner vertically disposed wall of the outer bladder and the outer vertically disposed wall of the inner bladder are the same wall.

4. Modular system according to claim 2 wherein the inner bladder is separate and distinct from the outer bladder.

5. Modular system according to claim 2 wherein means are provided in each said bladder to be connected to a pumping system whereby each said bladder can be exhausted separately to the outside of a fluid contained therein.

6. Modular system according to claim 2 wherein a submersible pumping system is provided in each of the inner and outer bladders.

7. Modular system according to claim 2 wherein at least one of said inner and outer bladder means is constructed from a lamination comprising a fabric of aramid yarn and sandwiched between synthetic rubber lamina.

8. Modular system according to claim 2 wherein said system further comprises securing means for releasably attaching said bladder means to said hull, said securing means being capable of disengaging the first bladder means from the hull in case of a sudden upward force on the bladder means.

9. Modular system according to claim 2 wherein said outer bladder means is capable of holding sufficient ballast liquid to create within said bladder means a hydrostatic pressure at a given vertical level greater than the hydrostatic pressure of water external to said hull at that level.

10. Modular system according to claim 2 wherein a plurality of tie means are located at spaced-apart intervals along the hull to maintain the desired shape of the outer buffer bladder means.

* * * * *